US008424218B2

(12) United States Patent
Seng et al.

(10) Patent No.: US 8,424,218 B2
(45) Date of Patent: Apr. 23, 2013

(54) HAIR-CARE APPLIANCE WITH IONIZATION DEVICE

(75) Inventors: Jürgen Seng, Kelkheim (DE); Olaf Sörensen, Mainz (DE)

(73) Assignee: Braun GmbH, Kronberg (DE)

( * ) Notice: Subject to any disclaimer, the term of this patent is extended or adjusted under 35 U.S.C. 154(b) by 587 days.

(21) Appl. No.: 12/301,945

(22) PCT Filed: May 23, 2007

(86) PCT No.: PCT/EP2007/004563

§ 371 (c)(1),
(2), (4) Date: Jul. 14, 2010

(87) PCT Pub. No.: WO2007/134848

PCT Pub. Date: Nov. 29, 2007

(65) Prior Publication Data

US 2010/0282270 A1 Nov. 11, 2010

(30) Foreign Application Priority Data

May 24, 2006 (DE) ..... 10 2006 024 319

(51) Int. Cl.
*A45D 7/02* (2006.01)

(52) U.S. Cl.
USPC ..... 34/97; 34/98; 132/220; 392/384; 239/690

(58) Field of Classification Search ..... 34/95, 96, 34/97, 98, 99, 100, 104, 105; 361/212, 230; 132/210, 220; 392/384, 385; 239/690
See application file for complete search history.

(56) References Cited

U.S. PATENT DOCUMENTS

| | | | | |
|---|---|---|---|---|
| 2,152,343 | A * | 3/1939 | Brown | 132/231 |
| 4,258,408 | A * | 3/1981 | Cantelli | 361/213 |
| 5,612,849 | A | 3/1997 | Prehodka | |
| 6,191,930 | B1 * | 2/2001 | Ramchandani | 361/213 |
| 6,393,718 | B1 | 5/2002 | Harris et al. | |
| 6,672,315 | B2 * | 1/2004 | Taylor et al. | 132/116 |
| 6,725,562 | B2 * | 4/2004 | Nakagawa et al. | 34/96 |
| 6,750,747 | B2 * | 6/2004 | Mandell et al. | 335/205 |
| 6,784,775 | B2 * | 8/2004 | Mandell et al. | 335/206 |
| 6,948,248 | B2 * | 9/2005 | Andis et al. | 30/34.05 |
| 6,986,212 | B2 * | 1/2006 | Saida et al. | 34/98 |
| 6,996,916 | B2 * | 2/2006 | Cafaro | 34/96 |
| 7,123,823 | B2 * | 10/2006 | Ceva | 392/385 |
| 7,287,532 | B2 | 10/2007 | Hafemann | |
| 2004/0129288 | A1 | 7/2004 | Saida et al. | |
| 2005/0061344 | A1 * | 3/2005 | Taylor et al. | 132/116 |
| 2007/0019501 | A1 | 1/2007 | Kiessl | |
| 2010/0282270 | A1 * | 11/2010 | Seng et al. | 132/210 |

FOREIGN PATENT DOCUMENTS

| | | |
|---|---|---|
| DE | 8018566 | 7/1979 |
| DE | 202004003593 | 3/2004 |
| DE | 103 51 265 | 6/2005 |
| DE | 202004019334 | 5/2006 |

(Continued)

*Primary Examiner* — Stephen M. Gravini
(74) *Attorney, Agent, or Firm* — Kim William Zerby

(57) ABSTRACT

An ionizing hair-care appliance includes a voltage source, an electrical conductor electrically connected to the voltage source, and an ionization electrode comprising a tip and electrically connected to the voltage source by the electrical conductor. The electrode is disposed within an ionization chamber defined by the hair-care appliance and defining an unobstructed opening through which the electrode tip is exposed.

14 Claims, 7 Drawing Sheets

FOREIGN PATENT DOCUMENTS

| | | |
|---|---|---|
| EP | 1 554 945 | 7/2005 |
| JP | 2004055351 | 7/2002 |
| JP | 2004-249135 | 9/2004 |
| WO | WO2006099556 | 3/2005 |

* cited by examiner

HAIR-CARE APPLIANCE WITH IONIZATION DEVICE

CROSS-REFERENCE TO RELATED APPLICATIONS

This application is the national stage of International Application No. PCT/EP2007/004563, filed May 23, 2007, which claims priority to German Application No. DE 102006024319.6, filed May 24, 2006.

TECHNICAL FIELD

The present invention relates to a hair care appliance having at least one ionization device.

BACKGROUND

When brushing, combing or drying hair, there is an unwanted build up of electrostatic charge on the hair, making it difficult to shape and set hair in a targeted manner in particular. Apart from unpleasantness for the person affected, dust particles collect to a greater extent on electrostatically charged hair, which may also result in the hair becoming dirty more rapidly.

Some hair care appliances, designed with an ionization device, use a carrier medium, e.g., a stream of air, to convey ions onto the hair to be neutralized. But this necessarily means that the ionization device must be set up in a stream of air and/or in the immediate vicinity of a stream of air. First, this restricts the design freedom of the hair care appliance, and secondly, the scope of use of such ionization devices is limited to such hair care appliances which generate a stream of air.

In addition, because of the eddy currents which are unavoidably present in the stream of air, this allows targeted and controlled application of ions to the hair in an inadequate manner. In particular due to the unavoidable and difficult-to-control air eddies in an air outlet, a substantial portion of the ions do not even reach the hair that is to be neutralized.

In addition, with the ionization devices known from the state of the art, the ionization tips are mostly produced from needles or curved sheet metal, having tips not only in the direction of flow of the ions but also in other directions, which have the effect of concentrating the electric field.

Parallel capacitances and resistances develop due to an electric connection between the ionization tip and the high-voltage-carrying high-voltage cable and due to the mounting of the tip, and these lead to parallel currents during operation of the ionization device; this greatly reduces the voltage achievable at the ionization tip.

However, if a high voltage sufficient for ionization is to be made available at the ionization tip, the high-voltage source must be designed with large dimensions accordingly.

SUMMARY

One aspect of the invention features an ionizing hair-care appliance having a voltage source coupled to the hair-care appliance, an electrical conductor electrically connected to the voltage source, an ionization electrode comprising a tip and electrically connected to the voltage source by the electrical conductor. In certain implementations, the electrode is disposed within an ionization chamber defined by the hair-care appliance and defining an unobstructed opening through which the electrode tip is exposed.

Another aspect of the invention features an ionizing hair-care appliance having a voltage source and an electrical conductor that is electrically connected to the voltage source. In some embodiments, the electrical conductor includes a wire that has an insulated base section and an exposed tip section. The exposed tip section may form an ionization electrode positioned within the hair-care appliance so as to impede build up of electrostatic charge while grooming hair.

Another aspect of the invention features a method of providing a hair-care device with an ionization electrode. The method may include removing insulation from a distal portion of an insulated electrical conductor to form an exposed portion of the electrical conductor, forming one or more tips from the exposed portion of the electrical conductor, positioning the exposed portion of the electrical conductor within an ionization chamber of a hair care device, such that the one or more tips point toward an opening of the ionization chamber, and coupling the electrical conductor to a voltage source of the hair-care device.

The hair care appliance has, in some embodiments, at least one ionization device for generating an ionization of air and a high-voltage source, which is connected by at least one electric line to the ionization device. The free end of the conductor is designed as an ionization electrode and has at least one area designed in the form of a tip for this purpose.

In certain embodiments, the ionization electrode is arranged inside an ionization chamber designed like a sleeve open at one end.

The open end of the area designed as an opening of the ionization chamber allows ions formed inside the ionization chamber on the ionization electrode to emerge unhindered. In some implementations, there are no objects such as an ionization grid or a protective grid to cover the opening of the ionization chamber.

Thus, during operation of the hair care appliance and/or the ionization device, the ions formed on the ionization electrode emerge from the ionization chamber merely due to the electrostatically induced effects and spread preferentially forming a large-volume ion cloud.

Some embodiments of the invention facilitate independent spreading of the ion cloud over a large area, so an air stream as a carrier medium for the ions thereby generated becomes unnecessary, so that the ionization device can be used in a greater variety of ways on the whole and more universally.

In some embodiments, the hair care appliance thus can include all hair care appliances and hair styling appliances such as straighteners or curlers and is not limited to such appliances that create a stream of air.

According to a first embodiment, a counter-electrode is provided at a distance from the ionization electrode. By means of this counter-electrode, the ion cloud emerging from the ionization chamber can be controlled and influenced in a targeted manner. The quantity, direction of propagation and rate of propagation of the ions generated inside the ionization chamber can be controlled by a predefined potential gradient between the ionization electrode and the counter-electrode.

The counter-electrode is also arranged outside of the ionization chamber. The counter-electrode here is preferably installed on the open end of the ionization chamber, so that the ions that can be generated by the ionization tip move in the direction of the counter-electrode on emerging from the ionization chamber.

In some embodiments, the counter-electrode has an essentially plate-like geometry or an essentially linear shape. The two electrodes, the counter-electrode and the ionization electrode are designed to be asymmetrical in particular. The ionization electrode preferably has a radius of curvature of less than 3 mm and is designed to be somewhat round or cylindrical in cross section in particular. On the other hand, the counter-electrode is designed to be plate-like, flat and/or having a radius of curvature greater than 1 cm. Due to this arrangement of the two electrodes, corona discharges should be created in particular, preferably resulting in a continuous air flow between the two electrodes with the ions thereby created as the charge carriers.

According to another embodiment, the counter-electrode is arranged radially and/or axially offset relative to the ionization electrode, based on the geometry of the ionization chamber. The relative positioning, the mutual alignment and the spacing of the two electrodes—the ionization electrode and the counter-electrode—may facilitate creating the ion cloud and achieving the efficiency of the ionization device as a whole.

The parameters which pertain to the geometry of the ionization chamber, the relative alignment and the arrangement of electrodes are preferably optimized and coordinated so that at a predefined voltage level between the ionization electrode and the counter-electrode, a maximum of ions can be generated.

According to another embodiment, the ionization electrode is arranged inside the ionization chamber approximately at the center.

In addition, the tip area of the ionization electrode runs essentially in the axial direction of the ionization chamber. The ionization electrode and/or its free end, tapering to a point in at least one area, is preferably aligned in parallel with the direction of the resulting ion stream or the direction of propagation of the ion cloud.

According to another preferred embodiment, the ionization electrode comes to lie in the area of the opening of the ionization chamber in the axial direction of the ionization chamber. According to another embodiment, an arrangement of the ionization electrode such that its free end also extends beyond the edge of the ionization chamber may be considered as the axial area for the positioning of the ionization electrode.

According to another embodiment, the free end of the ionization electrode is arranged inside the ionization chamber and is set back from the edge of the ionization chamber. Additional embodiments in between, such as a flush arrangement of the ionization electrode with the edge of the ionization chamber, are also conceivable.

The axial positioning of the ionization electrode with respect to the geometry of the ionization chamber is of great importance for the development of the largest possible ion cloud.

The ionization chamber is also designed to be cylindrical according to some embodiments.

An alternative embodiment of the ionization chamber has an elliptical cross section with two axes of symmetry. Such symmetrical geometries of the ionization chamber, like the cylindrical design, are advantageous for the development of a homogeneous cloud of ionized molecules of air.

According to another preferred embodiment, the electric conductor between the high-voltage source and the ionization device and/or the ionization electrode is designed as an uninterrupted and insulated high-voltage cable.

If the hair care appliance has multiple ionization devices, e.g., arranged so they are separated from one another spatially, then a separate high-voltage cable may be provided for each ionization electrode so that, except for the branch, high-voltage cables between the high-voltage source and the ionization devices can be avoided.

The electrodes of the ionization devices may be electrically connected directly to the high-voltage source without interruption and without any other connection means. Edges, steps or the like which would occur in the transition from a separate metal electrode to the connecting cable are avoided due to the design of an uninterrupted connection. The field concentrations associated with such edges or steps and the related losses of efficiency in terms of ion output can thus be prevented in a simple and easy manner.

According to another preferred embodiment of the invention, the tip area of the ionization electrode is formed by cutting it off. An oblique cut of the free end of the electric conductor connected to the high-voltage source is provided for this purpose in particular. This makes it possible to create a sharp-edged area of the ionization electrode that tapers to a tip, where a high field concentration occurs, which is advantageous for efficient ion emission.

Obliquely cutting off the conductor is easily implemented and furthermore facilitates the emission of the ions formed on the electrode. In addition, the electric conductor is designed as a stranded cable and the ionization electrode has a plurality of tip areas spaced a distance apart from one another and/or fanned out. These are then designed as the ends of the strands or flexible cables. This makes it possible to increase the ion output. The ends of the strands or flexible cables may be arranged so they are offset both radially and axially to one another.

The oblique cut to form a tip on the ionization electrode is preferably made at an angle of 30° to 70°, preferably approximately 45° to 60° to the direction of the conductor, forming a tip of the ionization electrode of approx 20° to approx 60°, preferably approx 30° to 45° to the direction of the conductor.

According to another advantageous embodiment of the invention, the high-voltage source has an open-circuit voltage of 2 kV to 7 kV, with its internal resistance preferably amounting to 5 to 30 megaohm, in particular 10 megaohm. This high internal resistance ensures that a sufficiently low short-circuit current is achieved.

Furthermore, a high internal resistance of the high-voltage source is also advantageous for the design of the ionization chamber, which is open at one end, and the design of the exposed ionization electrode arranged therein, especially since the propagation of the ion cloud should not be impaired by any design safety measures such as a grid.

According to another embodiment of the invention, the high-voltage source, the electrode and the electric conductor are designed so that a negative high voltage of 2.5 kV to 6 kV, measured at 1 gigaohm of the measurement device, is applied to the electrode. This provides in particular for the electric conductor and the ionization electrode, which are connected to the high-voltage source, to form a high parallel impedance to the internal resistance of the high-voltage source.

A low parallel impedance would be a disadvantage because it would form a voltage divider together with the internal resistance of the high-voltage source. This would result in a great drop in voltage on the internal resistor of the high-voltage source which cannot be used for ionization. The usable voltage on the electrode is virtually the open-circuit voltage of the high-voltage source due to the inventive design of the electrode.

Open-circuit voltages below 6 kV are possible with a high efficiency and a high internal resistance of 10 megaohm, for example. The comparatively low voltage thus allows the use of an inexpensive transformer for the high-voltage source.

According to another preferred embodiment, the diameter of the ionization chamber is in the range between 3 mm and 10 mm. The ionization electrode can be arranged in an area where it protrudes up to 2 mm from the edge of the ionization chamber or is set back from the edge of the ionization chamber by up to 6 mm.

The strand diameter of the cable may range from 2.5 mm to 0.05 mm. It is preferably between 0.15 mm and 0.3 mm. The electric conductor itself may be made of copper, nickel silver or other comparable conductive alloys or metals. Furthermore, carbon fibers having a strand diameter in the range greater than 3 μm may also be used.

In addition, the counter-electrode is arranged a distance between 5 mm and 20 mm away from the ionization electrode in the axial direction.

All the absolute size information is given only as an example and should merely represent the distance and size ratios of the individual components but not an absolute dimensioning of the individual elements of the ionization device.

The embodiments are not limited to a single hair care appliance but instead may be applied universally to a plurality of different hair care appliances, e.g., hair curlers, curling rods, straighteners or curlers. Other areas for use include, for example, hair stylers, hairbrushes as well as drying hoods or hair-drying appliances. Use in climate control equipment, air conditioners, humidifiers, and the like is conceivable in principle.

The hair care appliance can provide improvements with regard to efficiency, performance, manufacturing cost and cost of materials. Furthermore, a wider area of use for such ionization sources is contemplated. In particular, an efficient and far-reaching dispersal of ions may be made possible even without a carrier medium or a stream of air, and furthermore, the use of high-voltage sources with small dimensions and a low energy consumption should also be made possible.

Additional goals, advantages, features and advantageous possible applications of the present invention are derived from the following description of one exemplary embodiment on the basis of the drawings. All the features described and/or presented here graphically form the subject matter of the invention, even independently of the patent claims or references back to the claims.

DETAILED DESCRIPTION

Figure 1:
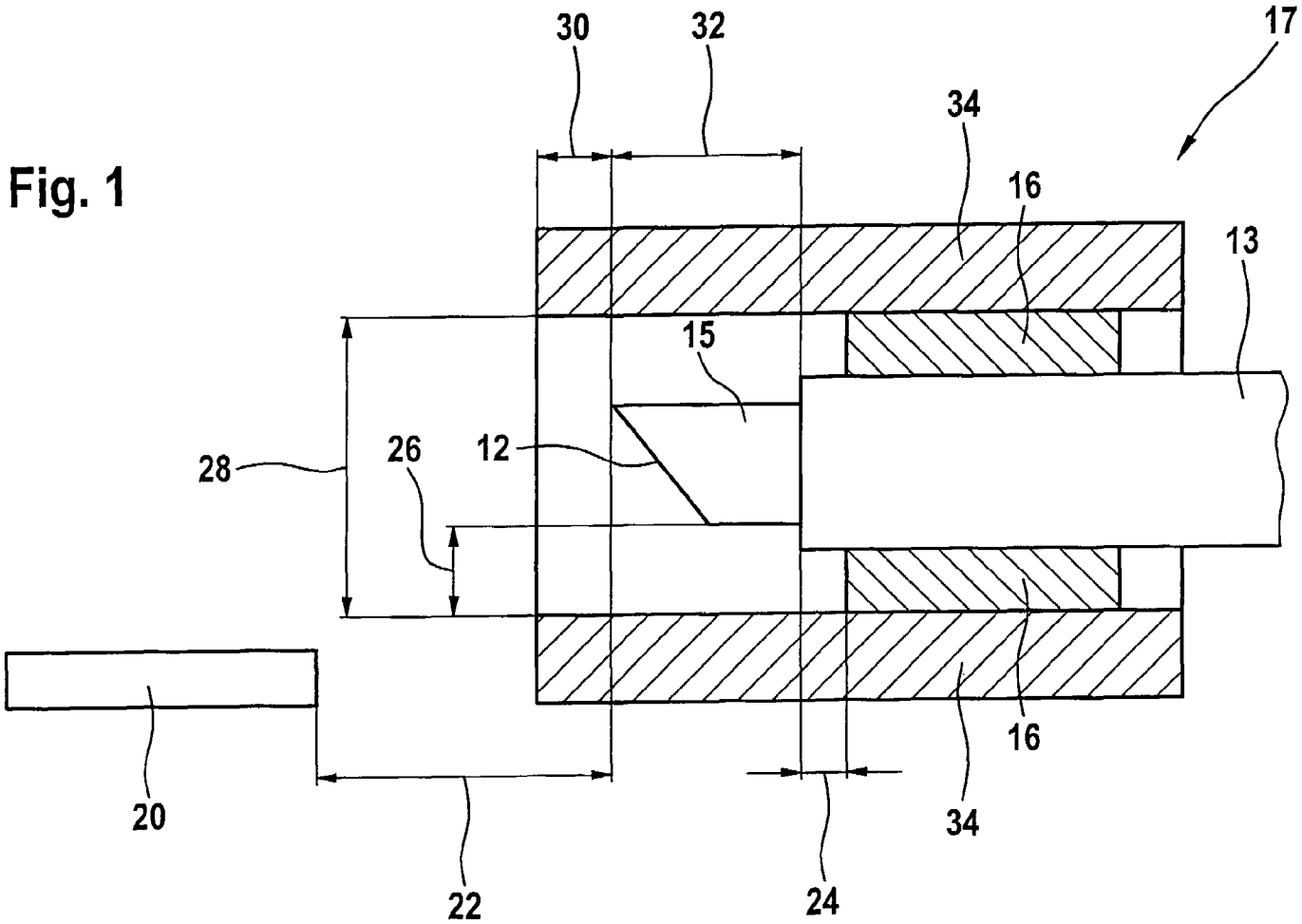
FIG. 1 shows a schematic diagram of the ionization device in a longitudinal cross section.

FIG. 1 shows a schematic diagram of the ionization device 17 in a longitudinal cross section. The ionization chamber 34, which is designed to be cylindrical, may be integrated into a housing of a hair care appliance 10 in any way. It is thus provided in particular that the ionization chamber 34 is integrated with its open area flush in a housing wall.

The electrode 12, which is designed to taper to a tip due to an oblique cut of an electric conductor 15, is arranged centrally inside the ionization chamber 34. This high-voltage cable 13 is held in a mount 16 which may be designed as an aluminum sleeve or may be made of insulating material, e.g., in the form of a silicone tubing or a plastic sleeve. Plastic materials that may be used here include in particular PBT, polyamide, polyurethane, ABS and PC.

The counter-electrode 20 is designed to be asymmetrical with the ionization electrode 12 and therefore has a plate-shaped but essentially linear geometry. It is arranged outside of the ionization chamber 34 and is also arranged radially and axially offset relative to the ionization electrode 12.

The dimensioning of the individual elements and their alignment and arrangement are of great importance for generating ions as efficiently as possible and/or producing a corona discharge between electrodes 20 and 12. The diameter 28 of the outlet channel for the ions should be in a range between 3 mm and 10 mm.

The distance 22 between the free end of the counter-electrode 20 and the acutely tapered end of the ionization electrode 12 is to be selected in a range between 5 mm and 20 mm. Likewise, the extra measure 24 on the insulated area 13 of the electric conductor 15 from the support 16 should be in the range of 0.5 to 5 mm.

The axial extent of the stripped area 32 of the free end 13 of the conductor is in a range from 1 mm to 5 mm. The distance 30 between the tip of the ionization electrode and the edge of the ionization chamber 34 is in a range from −2 mm to 6 mm. The negative amount here means that the tip of the ionization electrode 12 may not only be inside the ionization chamber 34 but may also be arranged so that it protrudes slightly away from the edge of the chamber.

In this exemplary embodiment, the radial distance 26 between the ionization electrode 12 and the inside wall of the ionization chamber 34 is in the range of 0.5 to 6 mm.

The absolute sizes given here are by no means to be understood as absolute values but instead should serve only to give an accurate representation of the size ratios of the individual elements and their distances from one another. It is self-evident that the ionization device 17 may also be implemented on a larger or smaller scale accordingly.

Figure 2:
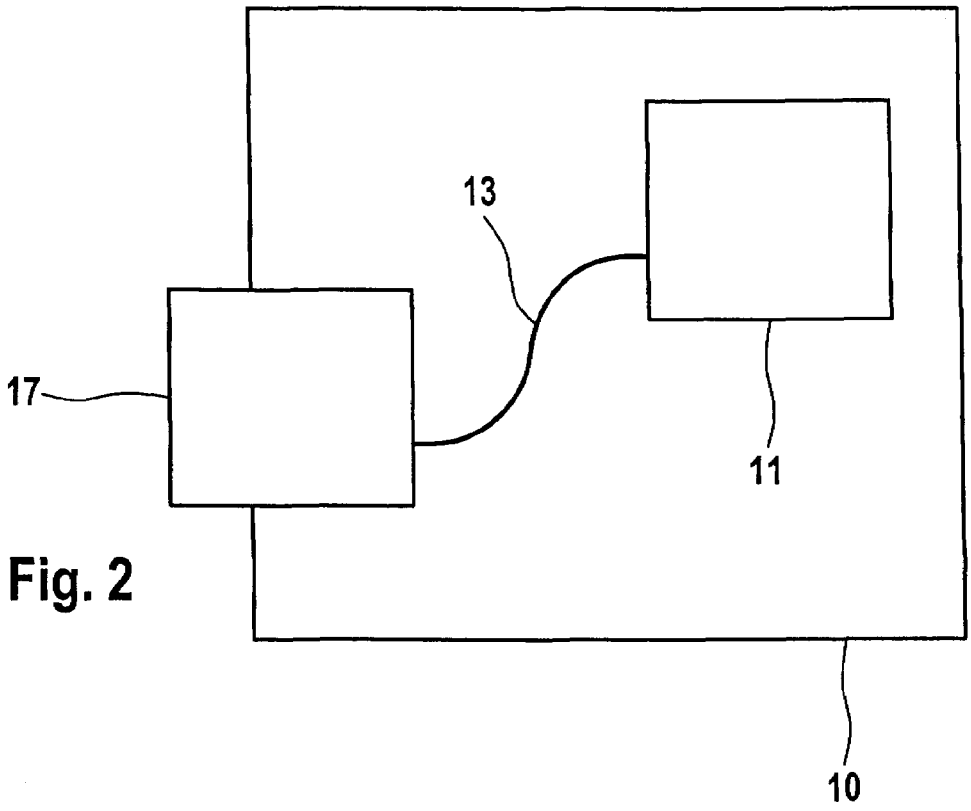
FIG. 2 shows a schematic diagram of the hair care appliance having an ionization device.

According to the purely schematic diagram of the hair care appliance 10 according to FIG. 2, the high-voltage source 11 is electrically connected by a continuous high-voltage cable 13 to the ionization device. The high-voltage source, which may be embodied as a transformer in particular, is designed to form a preferably negative high voltage of at least 2 kV and less than 6 kV, in particular less than 5 kV (each measured with 1 gigaohm of the measurement device at the electrode tip). Such dimensioning of the high-voltage source is made possible in particular by the one-piece design of the electrode 12 and the electric conductor 15.

Figure 3:
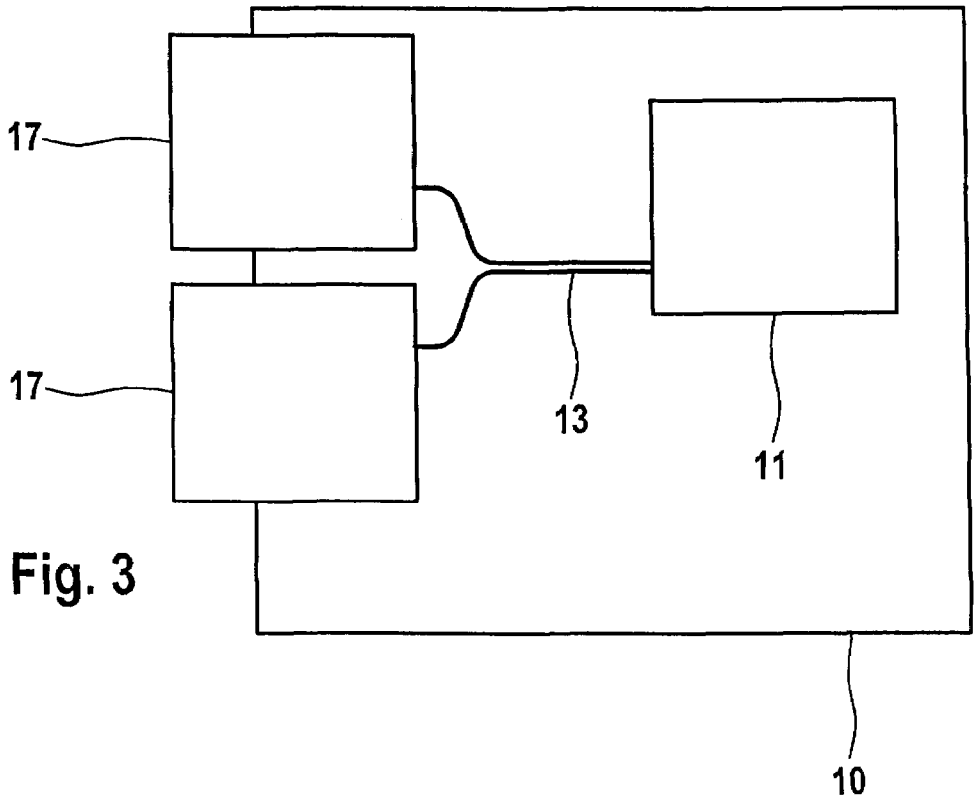
FIG. 3 shows a diagram of a hair care appliance according to FIG. 2 with an additional ionization device.

For example, if several ionization devices, as shown in FIG. 3, are provided on the hair care appliance 10, then they are preferably connected to the high-voltage source 11 by separate cables 13 in an electrically conducting manner or they are provided with a connection suitable for high-voltage purposes. This type of connection serves to avoid having other branches in the high-voltage cable 13, so that the electric conductor ultimately does not have any soldered joints, rivet connections or similar connections which would lead to a field concentration due to edges or steps and thus would result in a reduction in the ion output.

Figure 4:
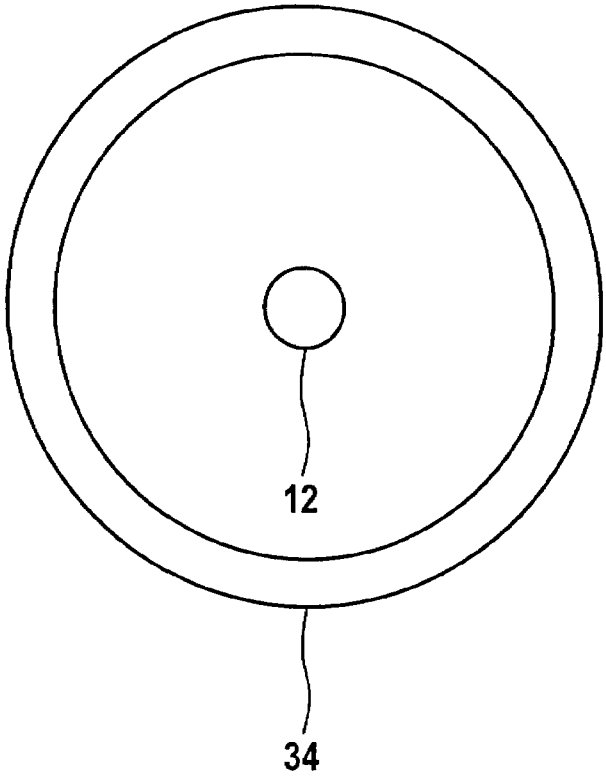
FIG. 4 shows a schematic diagram of the ionization device according to FIG. 1 in cross section.
Figure 5:
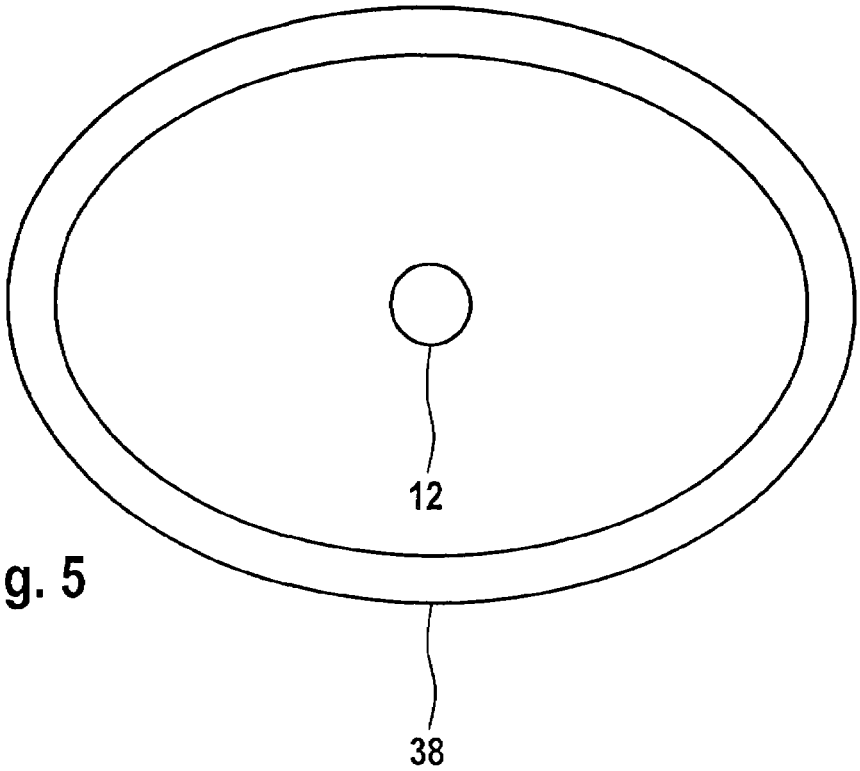
FIG. 5 shows an ionization chamber designed with an elliptical cross section.

FIGS. 4 and 5 each show one exemplary embodiment of an ionization chamber 34, 38 in cross section. In the exemplary embodiment according to FIG. 4, the ionization chamber 34 has a radially symmetrical cross section and thus has a cylindrical geometry, whereas in the exemplary embodiment according to FIG. 5, the ionization chamber 38 has an elliptical cross-sectional profile. In both embodiment variants, the ionization electrode 12 is mounted centrally in the ionization chamber 34, 38, so that the most homogeneous possible propagation of the ion cloud that can be produced is to be achieved.

Figure 6:
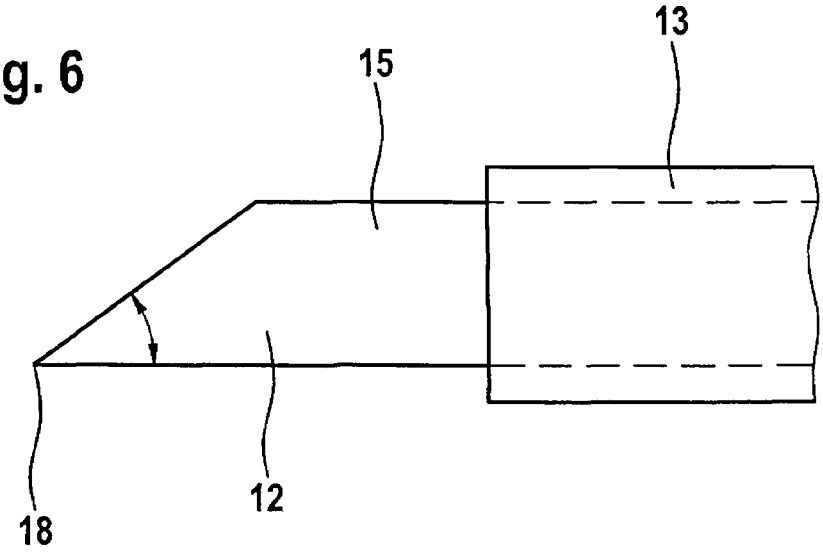
FIG. 6 shows a diagram of the electrode.

FIG. 6 illustrates the one-piece design of ionization electrode 12 and the electric conductor 15. The free stripped end of the cable 13 is thus the electrode 12 itself The electrode 12 is held directly and preferably only by the cable 13. According to FIG. 1, it is attached with its insulated area to the retaining element 16, which is designed in the form of a sleeve, inside the ionization chamber 34.

To achieve a better ion output, the conductor 15 is cut off obliquely so that a tip 18 is formed preferably of approx. 20° to 60°, especially approx. 30° to 45°. The conductor may also be cut off obliquely several times from different sides, so that the tip 18 lies in the center of the conductor. The conductor cross section of the electrode 12 after stripping off the insulation is preferably approx. 0.8 to 2 mm.

Figure 7:
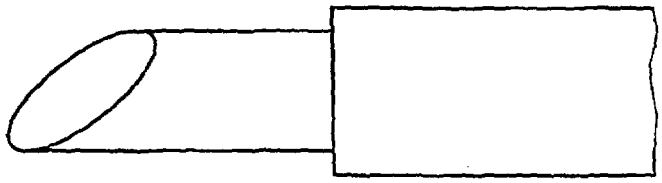
FIGS. 7-11 show variants of the electrode.
Figure 8:
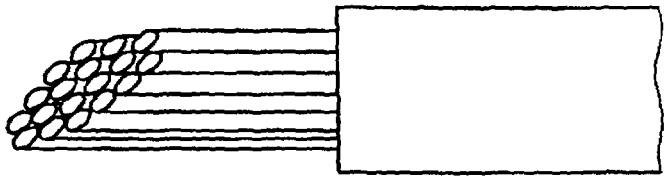

The conductor 15 and/or the electrode 12 may comprise a single strand as shown in FIG. 7 or may consist of cables having multiple strands, as shown in FIG. 6. A cable having multiple lines with several insulated conductors or even a stranded cable having multiple lines may also be used to form the electrode 12 (see FIGS. 9 to 11).

Figure 9:
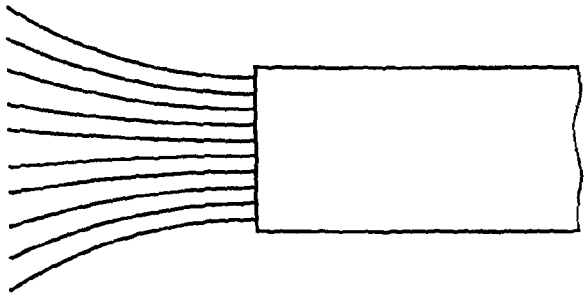
Figure 10:
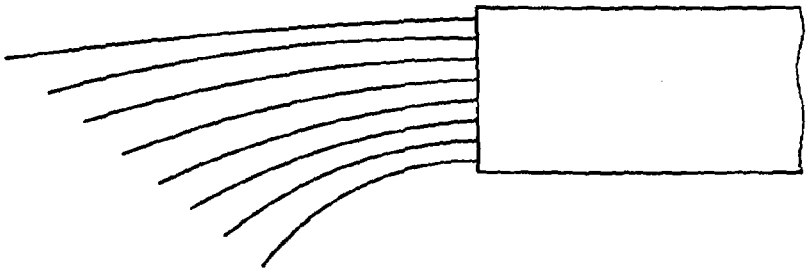
Figure 11:
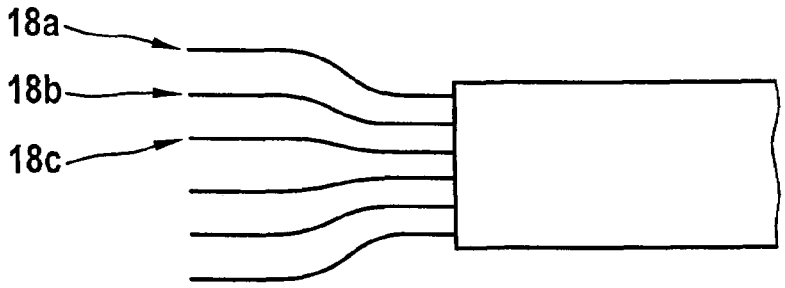

The end of the conductor may be fanned outward radially as shown in FIG. 9 or may be cut off obliquely, for example, and bent in a preferential direction as shown in FIG. 10. The individual line ends, preferably designed as strands, are then arranged side by side and one after the other. It is advantageous that several tip areas 18*a*, 18*b*, 18*c*, etc. are present. The tips are preferably arranged with the active direction toward the hair and in the direction of ion output.

Figure 12:
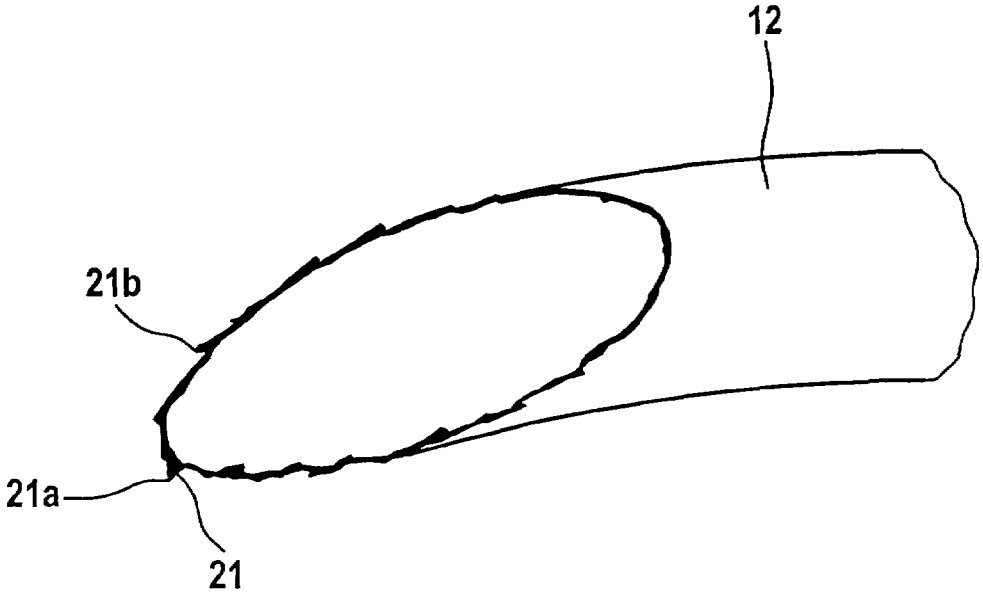
FIG. 12 shows a diagram of a cross-sectional area of the electrode.

Individual burrs 21, which are formed when the lines are cut as illustrated in FIG. 12, are especially advantageous. These in turn form additional tip areas 21*a*, 21*b*, etc. and/or a plurality of ionization tips and sharp edges. They thereby increase the effect of the electrode.

Figure 13:
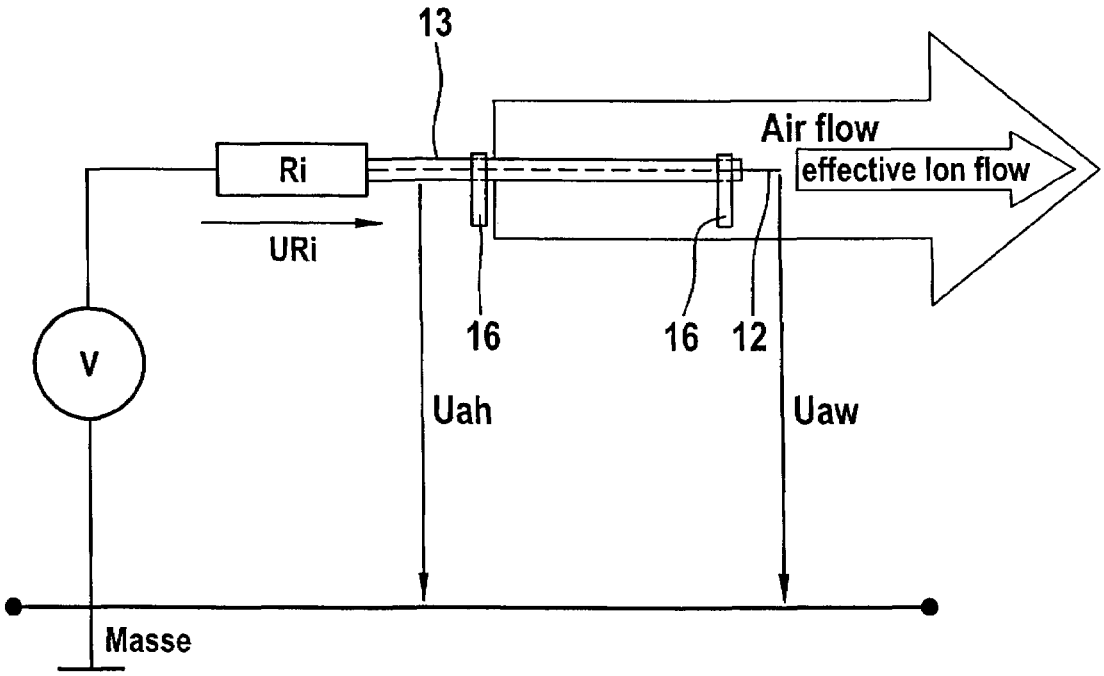
FIG. 13 shows a wiring diagram of the ionization device with a parallel capacitance and a parallel resistance, also showing an ineffective ion flow (arrow pointing upward).

It is especially advantageous that not only the electrode tip 18 but also the entire electrode 12 is exposed and/or the tip 18 points directly toward the opening of the ionization chamber, as shown in FIG. 1. The internal resistance Ri of the high-voltage source has hardly any effect on the voltage at the emitter of the electrode 12. The voltage Uah corresponds approximately to the voltage Uaw shown in FIG. 13.

This prevents the development of parallel impedances and/or parallel capacitances, which reduce the voltage Uaw by voltage splitting and thus have a negative effect on the ionization effect. The existence of such parallel impedances is noticed in particular at a high internal resistance of the generator Ri and also depends on the voltage shape. With steep pulses or high frequencies in particular, such a parallel capacitance acts like a short circuit, so that ion emission is prevented almost entirely.

Due to the one-piece electrode design, electrical and mechanical connections are prevented, at least in the area of the ionization electrode between the electrode and the cable; these could in turn lead to such unfavorable parallel impedances. Thus, no additional electric components are necessary in the tip area between the single branching tip and the ionization electrode.

Due to the arrangement having a low capacitance and the electrode provided here, a high-voltage generator with a lower power level and a lower voltage and/or lower current may be used. It is thus provided in particular that the internal resistance of the high-voltage source and/or the resistance of the arrangement as a whole meets the requirements for protective insulation according to IEC 335. To implement such a protective impedance, two independent resistors are provided in particular.

Furthermore, it is also possible for the tip 18 of the ionization electrode to be shaped by ultrasonic welding or formed by spark erosion. The end of the conductor and/or the electrode may also be pinched, pulled or formed from an intended breaking point, so that field concentration spots occur in the desired manner.

The invention claimed is:

1. An ionizing hair-care appliance, the hair-care appliance comprising:

a voltage source;

an electrical conductor electrically connected to the voltage source;

an ionization electrode comprising a tip and electrically connected to the voltage source by the electrical conductor; and a counter electrode; and wherein the ionization electrode is disposed within an ionization chamber defined by the hair-care appliance and defining an unobstructed opening through which the ionization electrode tip is exposed, wherein the counter electrode is disposed outside of the ionization chamber, and wherein further said ionizing hair-care appliance does not create an air stream as a carrier medium for the ions generated at the ionization electrode.

2. The ionizing hair-care appliance of claim 1, wherein the hair-care appliance comprises a sleeve that defines the opening through which the ionization electrode tip is exposed.

3. The ionizing hair-care appliance of claim 1, wherein the voltage source comprises an electrical transformer.

4. The ionizing hair-care appliance of claim 1, wherein the ionization electrode and the tip are contiguous with the electrical conductor.

5. The ionizing hair-care appliance of claim 1, wherein the ionization electrode and the tip are approximately coaxial with the ionization chamber.

6. The ionizing hair-care appliance of claim 1, wherein the tip is recessed within the ionization chamber.

7. The ionizing hair-care appliance of claim 1, wherein the tip extends through the opening of the ionization chamber.

8. The ionizing hair-care appliance of claim 1, wherein the electrical conductor comprises a cable comprising a plurality of strands, and wherein an end of each of the plurality of strands is spaced away from the other strands and is shaped in the form of a tip to form a plurality of ionization electrode tips.

9. The ionizing hair-care appliance of claim 1 wherein the counter electrode is both axially and radially offset from the tip of the ionization electrode.

10. The ionizing hair-care appliance of claim 1, wherein the voltage source has an open-circuit voltage between 2 kV and 7 kV and an internal resistance between 5 and 30 megaohms.

11. The ionizing hair-care appliance of claim 1, comprising an ionization-chamber sleeve disposed about the exposed ionization electrode tip section, wherein the ionization-chamber sleeve generally defines a cylindrical volume, and wherein the ionization electrode extends generally parallel to an axis of the cylindrical volume.

12. The ionizing hair-care appliance of claim 1, comprising an ionization-chamber sleeve disposed about the exposed ionization electrode tip section, wherein the ionization-chamber sleeve generally defines a volume having an elliptical cross section, and wherein the ionization electrode extends generally parallel to an axis of the elliptical volume.

13. The ionizing hair-care appliance of claim 1, wherein the counter electrode disposed outside of the ionization chamber has a plate-shaped geometry.

14. The ionizing hair-care appliance of claim 1, wherein the ionization electrode is arranged approximately centrally in the ionization chamber.

* * * * *